United States Patent [19]

Stewart et al.

[11] Patent Number: 4,540,459

[45] Date of Patent: Sep. 10, 1985

[54] DEVICE FOR JOINING THE PAYED-OUT END OF A STRIP, WHICH HAS BEEN WOUND INTO A REEL, WITH THE BEGINNING OF THE STRIP OF ANOTHER REEL

[75] Inventors: Iain G. H. Stewart, Wuppertal; Hans P. Pitz, Gevelsberg, both of Fed. Rep. of Germany

[73] Assignee: Maschinenfabrik Fr. Niepmann GmbH & Co., Gevelsberg, Fed. Rep. of Germany

[21] Appl. No.: 572,208

[22] Filed: Jan. 19, 1984

[30] Foreign Application Priority Data

Jan. 25, 1983 [DE] Fed. Rep. of Germany ..... 3302309

[51] Int. Cl.[3] ..... B65H 19/12; B65H 19/14; B65H 21/00

[52] U.S. Cl. ..... 156/504; 156/506; 156/518; 156/520; 242/56 R; 242/58.1; 242/58.2

[58] Field of Search ..... 156/157, 159, 504, 505, 156/506, 518, 520; 242/58.1, 58.2, 58.5, 56 R

[56] References Cited

U.S. PATENT DOCUMENTS 3,162,565 12/1964 Miller et al. ..... 156/506
4,278,489 7/1981 Horsley ..... 242/58.2
4,392,912 7/1983 Horsley ..... 242/58.2
4,443,291 4/1984 Reed ..... 156/504
4,462,858 7/1984 Goguen et al. ..... 156/506

*Primary Examiner*—Michael Wityshyn
*Attorney, Agent, or Firm*—Becker & Becker, Inc.

[57] ABSTRACT

A device, especially for cigarette-packaging machines, for joining the payed-out end of a strip, which had been wound into a reel, with the beginning of the strip of another reel. The device includes a buffer or storage device in which a certain length of the strip, which is conveyed over guide rollers, is stored, and out of which that amount of strip which is required for continuous operation is withdrawn during the joining process. The device is also provided with a separating and binding device. In order to provide for replacement of reels in a disturbance-free and semi- or fully-automatic manner at little structural expense, each reel is disposed in a cartridge on the wide sides of which the reel is mounted by means of a spindle which passes through the reel core and extends laterally out of the cartridge. The cartridge is provided with a support surface for the strip beginning of the reel, which is secured against rotation during transport of the cartridge; the strip beginning is held firmly in place on the cartridge. Specific embodiments of the cartridge and of the associated separating and binding device are also provided.

20 Claims, 24 Drawing Figures

Fig.8
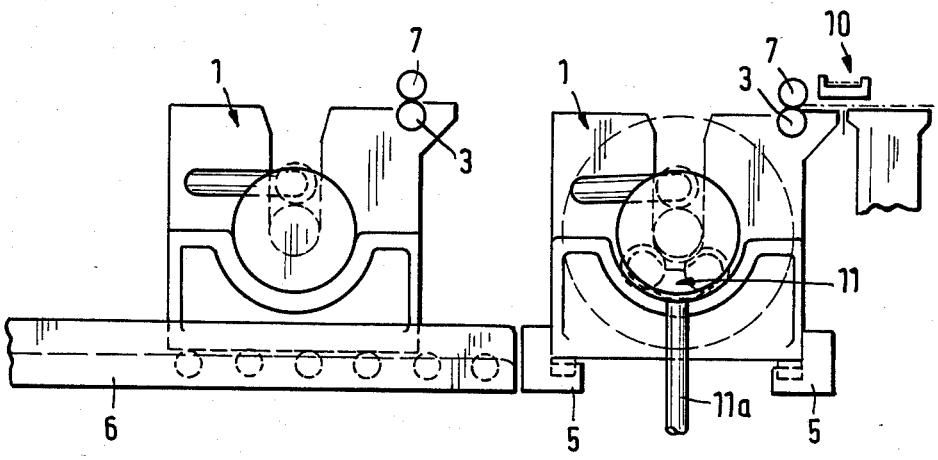
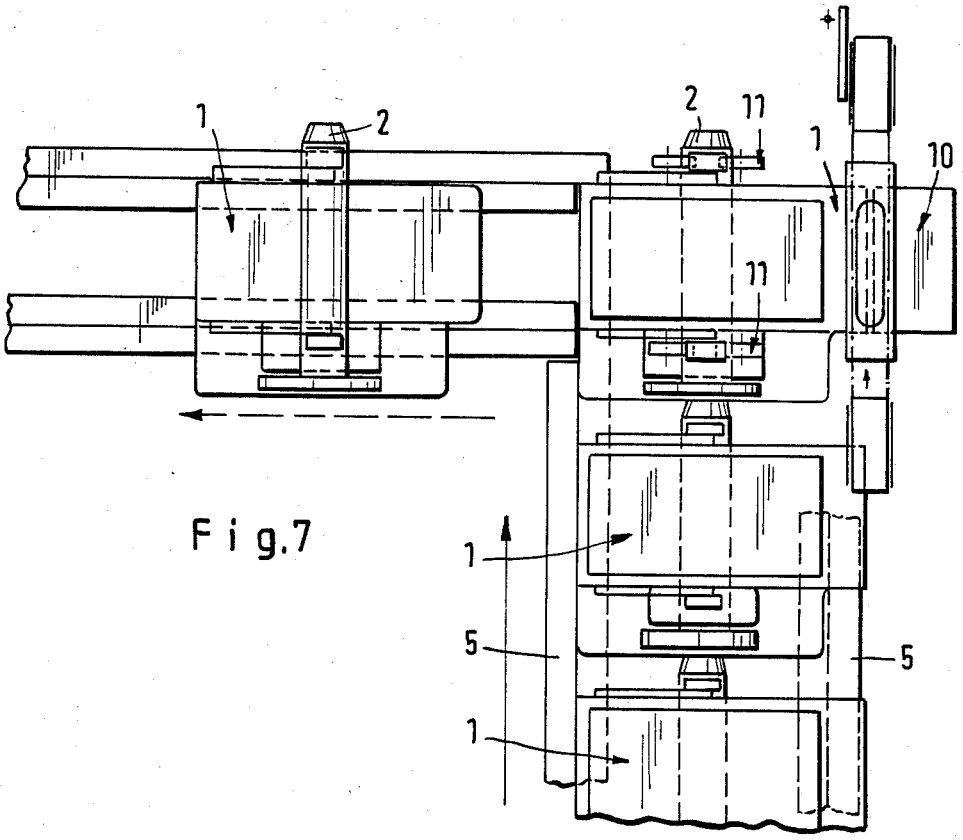
Fig.7

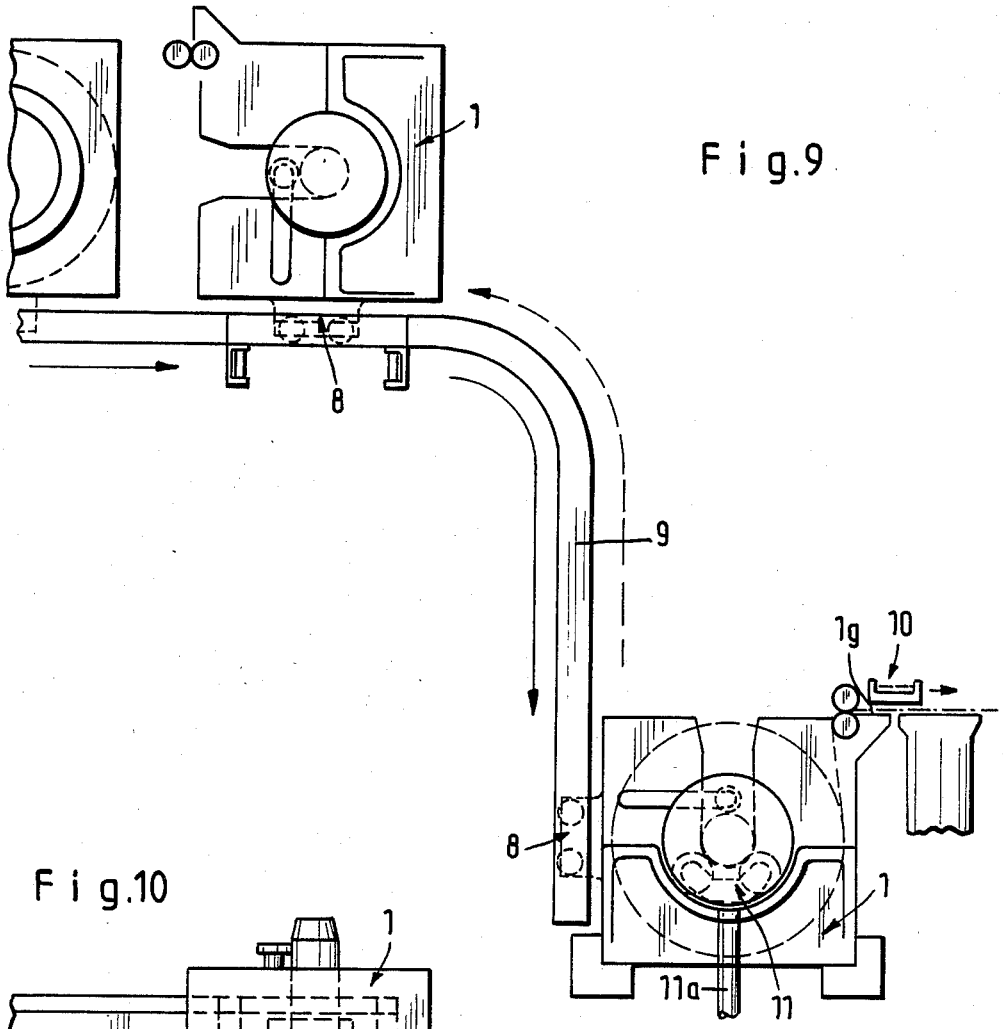
Fig.9
Fig.10
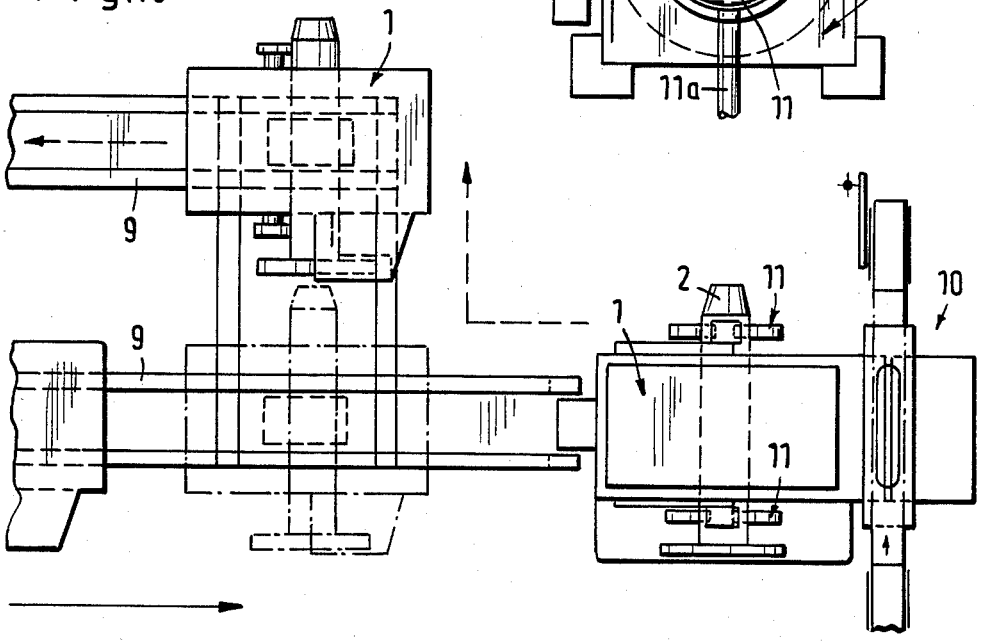

Fig.14
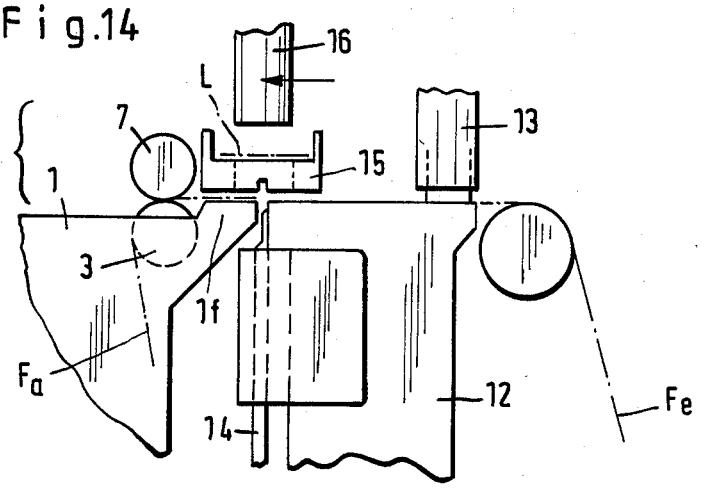
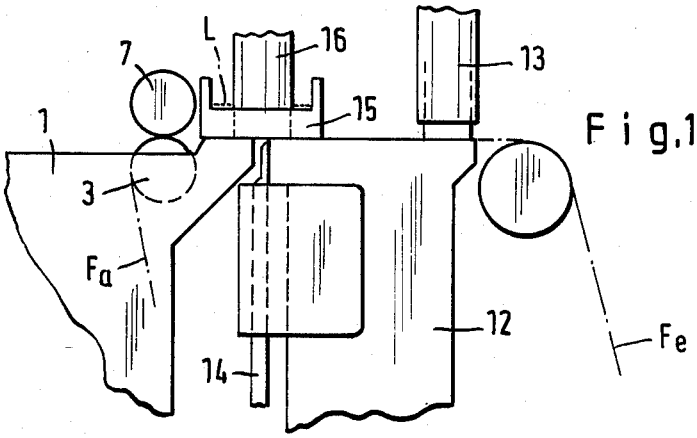
Fig.15
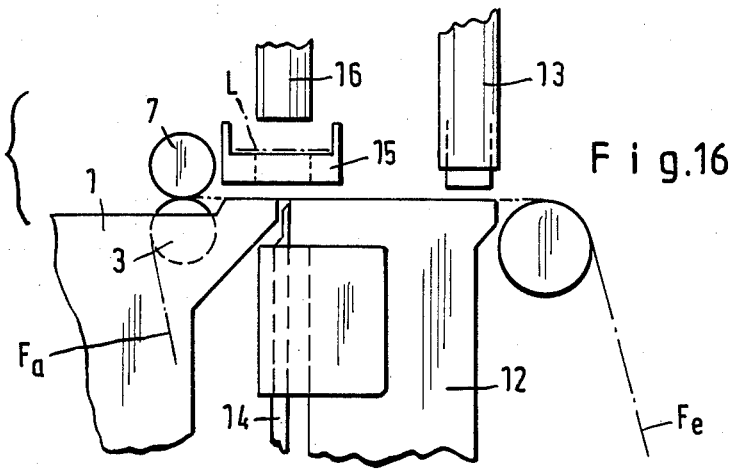
Fig.16

Fig.17
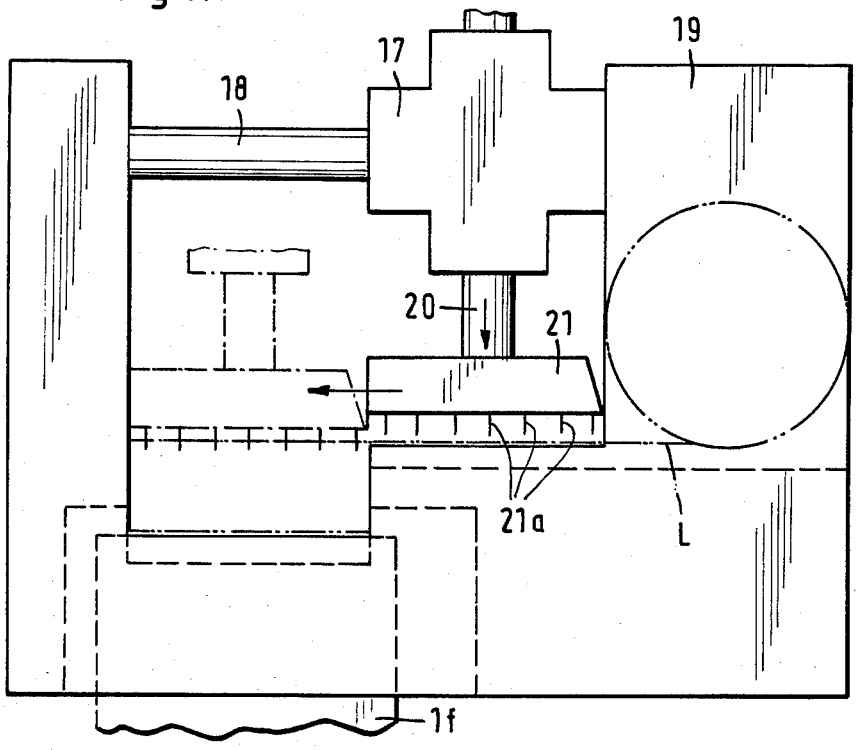
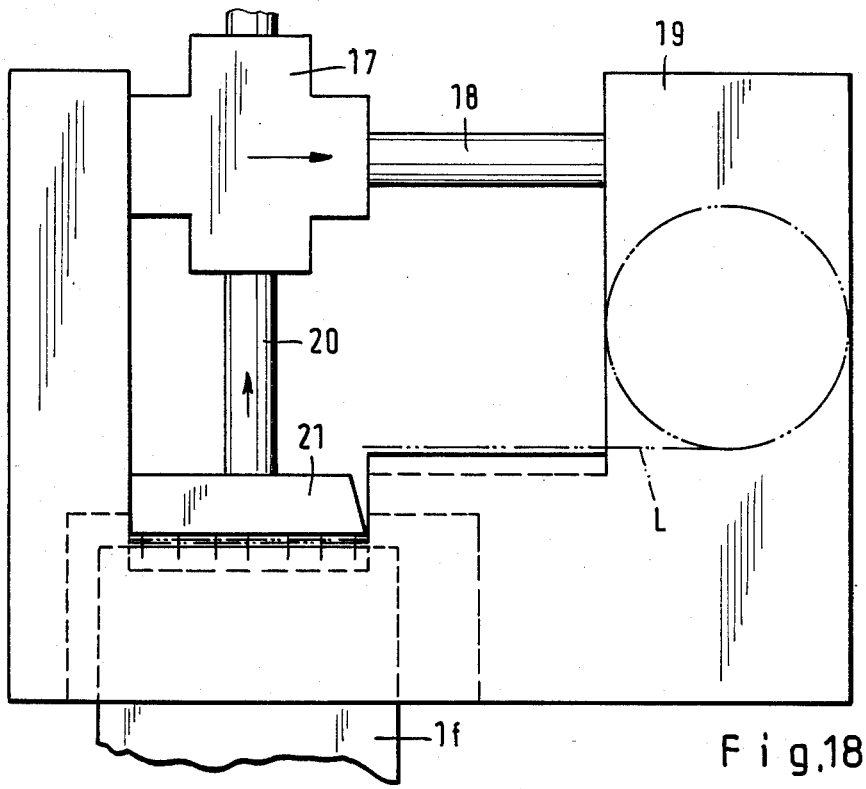
Fig.18

DEVICE FOR JOINING THE PAYED-OUT END OF A STRIP, WHICH HAS BEEN WOUND INTO A REEL, WITH THE BEGINNING OF THE STRIP OF ANOTHER REEL

BACKGROUND OF THE INVENTION

The present invention relates to a device, especially for cigarette-packaging machines, for joining the payed-out end of a strip, preferably a thin sheet of aluminum, paper, coated paper, plastic, or cellophane-like material, which had been wound into a reel, with the beginning of the strip of another reel. The device includes a buffer or storage device in which a certain length of the strip, which is conveyed over guide rollers, is stored and out of which that amount of strip necessary for continuous operation is withdrawn during the joining process. The device is also provided with a separating and binding device.

Devices for joining the tail end of a payed-out strand of material with the front end of a new strand are known, for example for cigarette-packaging machines. For example, German Pat. Nos. 1 141 848 and 1 250 229 show unwinding devices with which it is possible to switch a payed-out reel for a new strand reel without having to reduce the speed with which the strand is unwound. Due to the high output of the packaging machines, which must be supplied with strands or strips which are wound into reels, is necessary to frequently replace the reels. This replacement of the heavy reels is a burden on the operators, who have to be available for this purpose with each cycle. Threading the newly placed end of the thin sheet requires care and accuracy on the part of the operators if no breakdowns are to occur during the replacement of empty reels for available fill reels.

Numerous attempts have been made to carry out the replacement of the reels in a semi- or fully-automatic manner. Apart from the disturbances which occur during replacement of reels, the heretofore proposed constructions have the drawback that two reel-unwinding devices must be present for each strand; these devices not ony require a lot of space, but they also obstruct accessibility, especially with multi-strand or track machines.

It is an object of the present invention to avoid the drawbacks of the heretofore known devices for joining the payed-out end of a strand, which has been wound into a reel, with the beginning of the strip of a new reel, and to provide a device which, with little structural expense, makes it possible to rep1ace reels in a semi- or fully-automatic manner without encountering disturbances or interruptions.

BRIEF DESCRIPTION OF THE DRAWINGS

This object, and other objects and advantages of the present invention, will appear more clearly from the following specification in conjunction with the accompanying drawings, in which:

FIG. 7 is a plan view of a device for feeding filled cartridges and for withdrawing empty cartridges in a semi-automatic manner;

FIG. 8 is a side view of the device of FIG. 7;

FIG. 9 is a side view showing fully-automatic feed and withdrawal of cassettes;

FIG. 10 is a plan view of the device of FIG. 9;

FIGS. 11–16 show six different operating positions of a first inventive embodiment of a separating and binding device for joining the payed-out end of the strip of an empty cartridge with the beginning of a strip of a new cartridge;

FIG. 17 is a side view of a second inventive embodiment of a separating and binding device;

FIG. 18 shown the device of FIG. 17 in a different working position;

SUMMARY OF THE INVENTION

Figure 1:
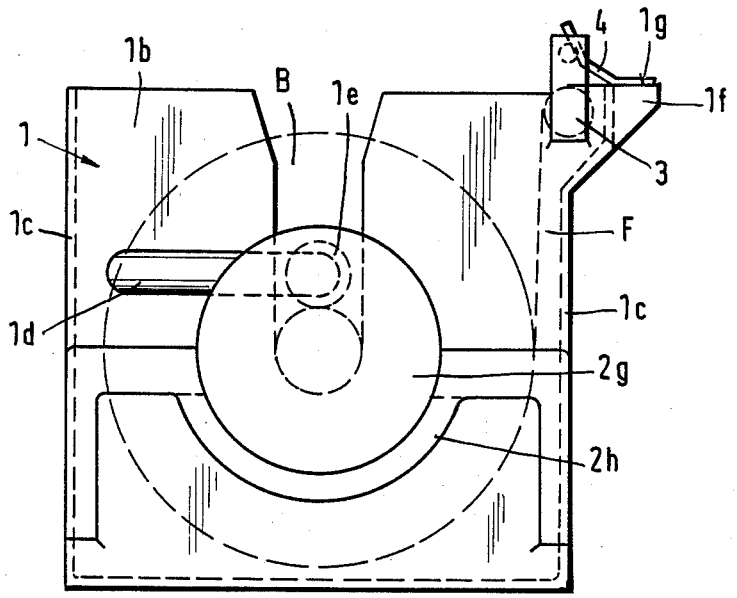
FIG. 1 is a side view of a first inventive embodiment cartridge for receiving a reel.
Figure 2:
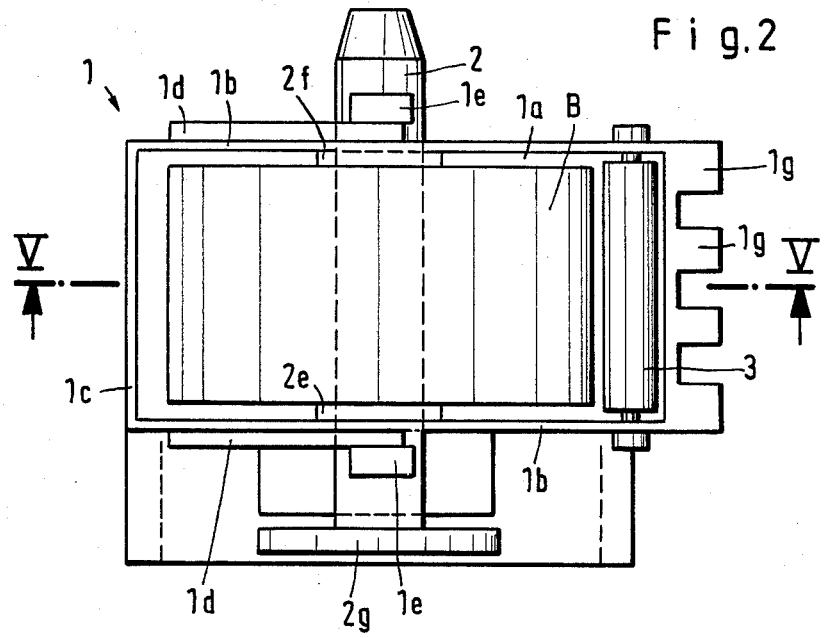
FIG. 2 is a plan view of FIG. 1.
Figure 3:
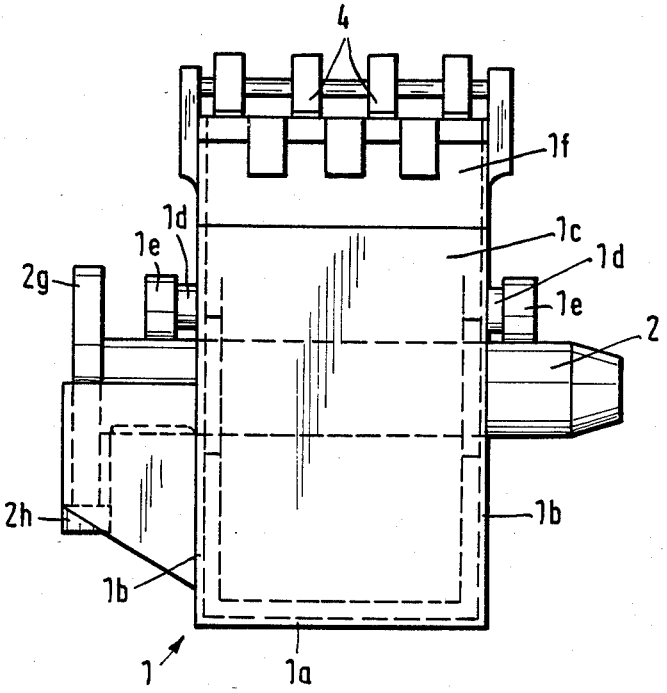
FIG. 3 is a front view of the cartridge of FIGS. 1 and 2.
Figure 4:
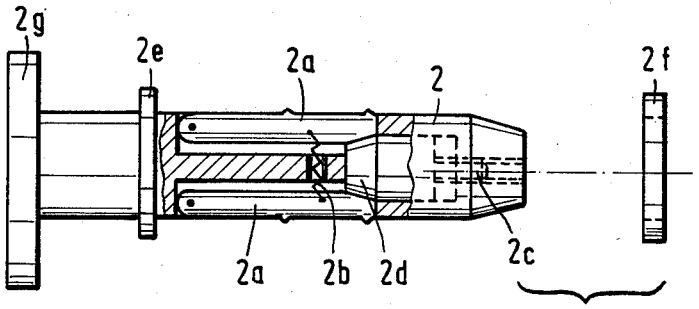
FIG. 4 is a partially longitudinally sectioned view of the spindle.
Figure 5:
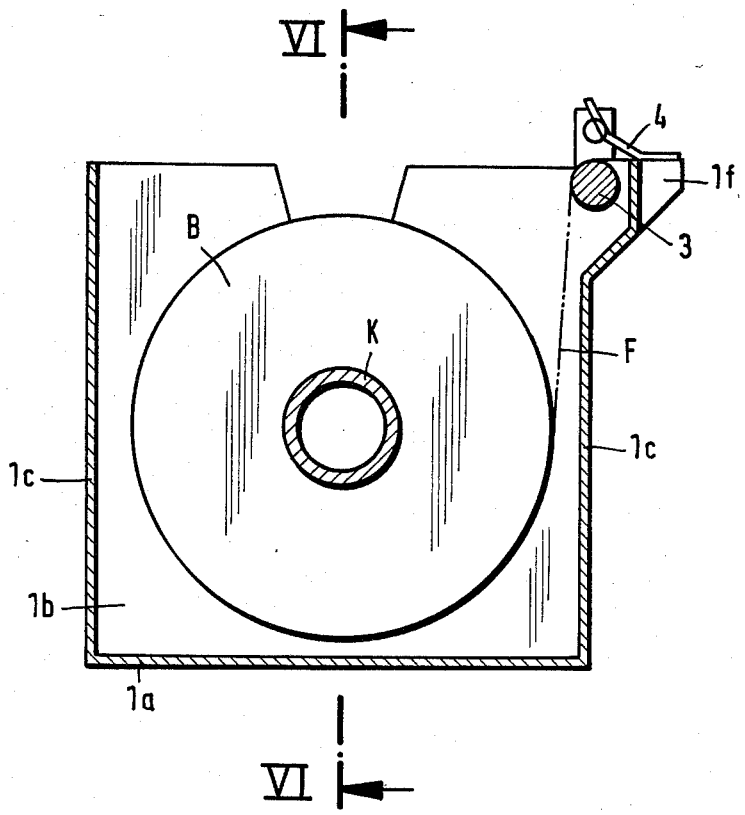
FIG. 5 is a vertical section taken through the cartridge along the line V—V of FIG. 2.

The device of the present invention is characterized primarily in that each reel is disposed in a cartridge, on the wide sides of which the reel is mounted by means of a spinde which passes through the reel core and projects laterally out of the cartridges; furthermore, the cartridge is provided with a support surface for the beginning of the strip of the reel, which is secured against rotation during transport of the cartridge, with the strip beginning being held firmly in place on the cartridge.

As a result of the proposal of the present invention, it is no longer necessary to have to provide space for two reel-unwinding devices for each track of the packaging machine. The reels can be disposed in the cartridge in a chamber which is removed from the packaging machine, and can be prepared for the reel replacement by having the beginning of a strip held in position on the inventive support surface of the cartridge.

During replacement of the cartridge, and the joining of the payed-out end with the beginning of a strip of a new reel, the strip necessary for continuous operation of the packaging machine is withdrawn from the storage device which, after the cartridge replacement has been carried out, within a very short time, for example one minute, is again filled during the normal feed of the reel. Finally, due to the inventive cartridge, damage to the reels, which are in part very sensitive, is precluded. Furthermore, the operators along the packaging line are relieved, and disturbances caused by incorrecty threaded ends of the thin sheets are prevented. The advantages obtained, especially for multi-track packaging machines, that considerably less space is required for replacement of the reels, and that therefore the accessibility is improved, especially since not only a semi- or fully-automatic feed of the cartridges which are filled with reels, but also a semi- or fully-automatic withdrawal of the empty cartridges is possible, as a result of which the operator is relieved and the efficiency of the machine can be increased.

Pursuant to one preferred specific embodiment of the present invention, the cartridge is embodied as a parallelepipedal housing having an open top and, in alignment with the open top, is provided with a projecting portion which extends beyond the adjacent narrow side and on which the support surface for the beginning of a strip is provided. In order to firmly hold the reels in place on the cartridges during transport, it is possible to either provide the bottom of the cartridge with an arcuate recess as the support surface for the full reel, or the spindle of the reel can be secured to the wide sides of the cartridge.

Pursuant to a further preferred embodiment, expanding elements are provided in the spindle for connecting the spindle with the reel core. The spindle may be secured in position by means of levers on the side walls, so that the reel is prevented from falling out during transport of the cartridge by means of the spindle.

It is inventively possible to provide at least two spacer rings on the spindle for axially securing the reel on the spindle, and/or the spindle in the cartridge.

It is furthermore inventively proposed to provide the spindle with a brake or friction disk for preventing rotation and/or for braking during withdrawal of the strip. Such a disk increases not only the friction surface for securing the reel during transport of the cartridge, but also provides the possibility of precisely braking the reel during withdrawal of the strip from the cartridge.

So that the reel, which during transport of the cartridge is secured against rotation either by resting in a recess of the cartridge or by being secured by the brake or friction disk, can freely rotate in the operating position of the cartridge, the spindle can be lifted into a roll-off position within the cartridge by means of two pairs of lift-out rollers which, in the operating position of the cartridge, engage parts of the spindle located externally of the cartridge. In this roll-off position, the spindle rests only on the total of four rolers of the two pairs of lift-out rollers, so that no abrasion occurs between the rotating spindle and the cartridge.

Pursuant to another preferred embodiment of the present invention, the beginning of the strip of the reel is secured by a hold-down device which presses against the support surface of the cartridge. The hold-down device can be swung away for insertion of the strip beginning.

Pursuant to a further possible embodiment of the present invention, the strip beginning of the reel, which is conveyed over a guide roller, can be secured by finger-like retainer springs on support projections which are spaced from one another and which are provided next to one another on the projecting portion of the cartridge. With this embodiment, welding or pressure punches can be inserted between the support projections and the retainer springs of the cartridge to weld or join together the strip beginning of the new reel with the overlapping strip end of the old rest.

In order to achieve semi-automatic replacement of cartridges, the cartridge can, pursuant to a further feature of the present invention, be adapted to be fed to the separating and binding device by means of guide rails which contact the lower corners of the cartridge, and can be withdrawn from the separating and binding device after the reel has been payed-out. The guide rails for feeding and withdrawing the cartridge are preferably disposed at right angles to one another, so that the filled cartridges can be successively fed to the separating and binding device, and the empty cartridges can be individually withdrawn at right angles to this direction of feed.

In order to allow replacement of the cartridges to be carried out fully-automatically, it is proposed pursuant to the present invention that each cartridge be provided with a carriage for an automatically controlled track arrangement which feeds to the separating and binding device the cartridges which are filled in a packing room, and withdraws the empty cartridges.

The separating and binding device is inventively provided with a base or anvil on which one side of the payed-out end of the strip of an empty cartridge can be secured by means of a clamping mechanism, and of which on the other side, which faces the cartridge, can be severed by a knife or doctor bade. The anvil is also provided with a bridge for joining the strip beginning of the reel, which is disposed in a new cartridge which has replaced the empty cartridge, with the band end which is secured on the anvil. This embodiment of the separating and binding device allows a fully-automatic joining of the payed-out end of a reel with the strip beginning of a new reel. In this connection, it is possible to either flushly abut the beginning and end of the strips and to join them by means of an adhesive tape or the like, or to overlap the strip end and beginning and to join or weld them together in the region of the overlap.

Pursuant to another preferred embodiment of the present invention, a roll of adhesive tape is disposed transverse to the longitudinal direction of the strip. A carriage provided with needles horizontally withdraws the adhesive tape in conformity to the width of the thin sheet. Upon lowering of a punch, the adhesive tape is first cut off, and this portion of the tape is then pressed onto the available end and beginning of the strips in order to join them.

Pursuant to a further possible embodiment, the bridge is embodied as a guide for an adhesive tape which extends transverse to the longitudinal direction of the strip, and which is applied at least partially by means of a punch onto the end and beginning of the strips. This joining of the flushly abutting end and beginning of the strips can be advantageously improved if the punch only punches out portions of the adhesive tape and applies them to the end and beginning of the strips, because in this way the adhesive tape, which is provided with punched-out portions, can be continuously withdrawn, for example from a roll, so that the feed and conveying of the adhesive tape are simplified.

If the strip end is to be joined with the strip beginning by means of an overlap, it is proposed pursuant to the present invention that an extensible loop-forming roller be disposed on the anvil, and that the bridge or carriage be provided with a suction pick-up element which is movable in the longitudinal direction of the strip, and which, after the strip end is severed when the loop-forming roller is extended, places the thus formed overlap material over the strip beginning of the available cartridge when the loop-forming roller is retracted. A joining of the beginning and end of the strips can now be effected by means of the welding or pressure punch which is guided between the spaced-apart support projections of the cartridge. Where the strip material cannot be welded, it is possible to replace the welding process with an adhesion process if, for example, the beginning of the strip which is secured on the support surface of the cartridge is moistened with an activatable adhesive.

DESCRIPTION OF PREFERRED EMBODIMENTS

Referring now to the drawings in detail, the cartridge 1, which is illustrated in FIGS. 1 to 6 with the aid of one specific embodiment of the present invention, serves to receive a reel B of strip F, which is wound onto a reel core K, and is preferably a thin sheet of aluminum, paper, coated paper, plastic, or a cellophane-like material. Such strips F are used, for example, in cigarette-packaging machines, where it is necessary, for the continuous packaging process, to join each payed-out end of the strip F, which is wound into a reel B, with the beginning of the strip of a new reel B. During this joining process, the strip F which is required for the continuous packaging process is dispensed from a buffer or storage device in which a certain length of the strip F, which is conveyed over guide rollers, is stored. Since this situation is known, it has not been illustrated in the drawings.

The exemplary cartridge 1 shown in FIGS. 1 to 6 is embodied as a parallelpipedal housing having an open top, a bottom 1*a*, two wide sides 1*b*, and two narrow sides 1*c*. The reel B is supported in the cartridge 1 by means of a spindle 2 which can be introduced from above into facing slots in the wide sides 1*b* of the cartridge 1. As can be seen from the sectional views of the spindle 2 in FIGS. 4 and 6, at least two expanding elements 2*a* are disposed in the spindle 2. The expanding elements 2*a* can be pivoted, counter to the force of a tension spring 2*b*, by an expansion cone 2*d*, which can be shifted by means of an adjusting screw 2*c*, in such a way that they rest inwardly on the reel core K, which is preferably made of cardboard, in order to keep the reel core from turning on the spindle 2. It would also be possible to actuate the expanding elements 2*a* pneumatically. In order to axially fix the position of the spindle 2 within the cartridge 1, the spindle 2 is provided with a fixed spacer ring 2*e* against which the reel core K rests when the reel B is placed on the spindle 2. By means of a spacer ring 2*f* which can be put on subsequently, the reel core K is kept from sliding axially off the spindle 2. This spacer ring 2*f* could also be fixedly arranged on the spindle 2 next to the spacer ring 2*e* and at a distance therefrom which corresponds to the thickness of the wall of the cartridge 1.

Figure 6:
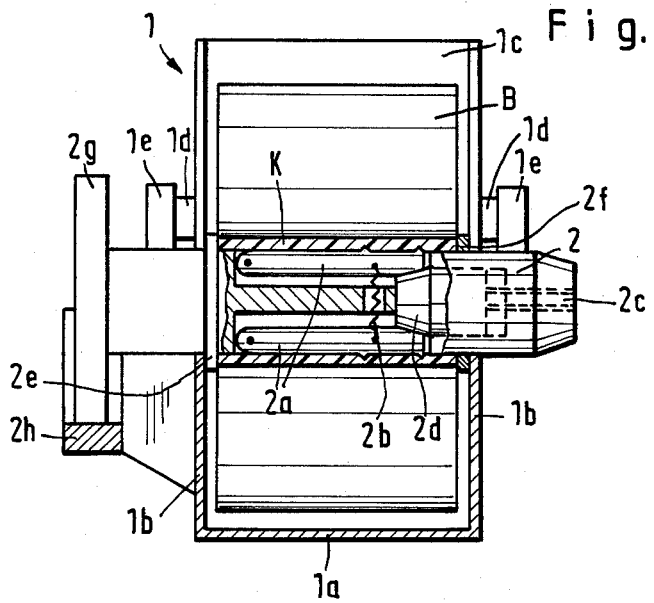
FIG. 6 is a cross-sectional view taken through the cartridge along the line VI—VI of FIG. 5.

In order to prevent the spindle 2, and hence the reel B, from falling out of the cartridge 1 while the latter is being transported, levers 1*d* are pivotably mounted on the wide sides 1*b* of the cartridge 1. The free ends of the levers 1*d* are equipped with pressure rollers 1*e* which in the functional position of the levers 1*d* press upon the spindle 2 which has been inserted into the cartridge 1, thus firmly holding the spindle 2 in place in the slot of the cartridge 1. This is best shown in FIGS. 1 to 6, with FIG. 6 showing how the spacer rings 2*e* and 2*f*, which are disposed within the cartridge 1, i.e. between the wide sides 1*b*, prevent the spindle 2 from axially sliding out of the cartridge 1. the levers 1*d* are preferably spring loaded, with the springs not being illustrated in the drawings in order to facilitate illustration.

In order to prevent the reel B from turning within the cartridge 1 when the latter is being transported, the bottom 1*a* of the cartridge 1 can be provided with an arcuate recess as a support surface for the full reel B. Furthermore, as is the case with the embodiment illustrated in FIGS. 1 to 6, it is possible to rigidly secure the reel B on the wide sides 1*b* of the cartridge 1 during transport of the latter via the spindle 2, which is rigidly connected with its reel core K. In this embodiment, the spindle 2 is provided with a brake or friction disk 2*g* which, in the transport position of the reel B within the cartridge 1, rests on a section of a brake ring 2*h* which is provided on the outside of one of the wide sides 1*b* of the cartridge 1.

In alignment with the open top, the cartridge 1 is provided with a projecting portion 1*f* which projects beyond the adjacent narrow side 1*c* and is provided with a support surface 1*g* for the beginning of the strip F. In the embodiment illustrated in FIGS. 1 to 6, the beginning of the strip F is conveyed over a guide roller 3 which is adjacent to the projecting portion 1*f*, and is held firmly in place on the support surface 1*g* by means of a comb-like hold-down device 4 which is spring-loaded, the spring not being shown. This comb-like and spring-loaded hold-down device 4 is omitted in the plan view of FIG. 2 in order to facilitate illustration.

In order to feed the cartridge 1, which has been filled with a new reel B, as shown for example in FIG. 1, to a packaging machine, such as a cigarette-packaging machine, a semi-automatic apparatus can be used, such as the embodiment illustrated in FIGS. 7 and 8. These figures show guide rails 5 and 6, which engage the lower corners of the cartridge 1. The guide rails 5 feed the cartridges 1 which have been provided with new reels B to a separating and binding device 10. The guide rails 6, which extend at right angles to the guide rails 5, are primarily provided for withdrawing cartridges 1 which are provided with an empty reel core K after the end of the strip thereof has been secured on the separating and binding device 10. In the embodiment illustrated in FIGS. 7 and 8, the full cartridges 1 are fed as a result of a slope of the guide rails 5, and the empty cartridges 1 are withdrawn by hand by means of the guide rails 6. As indicated in FIG. 8, bearing rollers can be disposed in the guide rails 5 and 6 in order to reduce the friction.

FIG. 8 also shows a modified embodiment of the cartridge 1. In place of a comb-like hold-down device as shown in FIGS. 1 to 6, a roller 7 which resiliently presses against the guide roller 3 is utilized. The construction and operation of the separating and binding device 10 will be described subsequently.

In place of the semi-automatic feed and withdrawal of the cartridges 1 to the separating and binding device 10, a fully-automatic apparatus can also be used, as illustrated with the aid of the embodiment of FIGS. 9 and 10.

As can be seen in particular from the side view of FIG. 9, with this embodiment each cartridge is provided on one narrow side 1*c* with a carriage for an automatically-controlled track arrangement 9 which feeds the cartridges 1 in a vertical direction to the separating and binding device 10, and withdraws them in the opposite direction thereto. Upon demand, cartridges 1 filled with full reels B are brought via this track arrangement from a holding position to the separating and binding device 10, in which the beginning of the strip F, which is secured on the support surface 1*g*, is automatically glued or welded to that end of the previous reel B which is secured in the separating and binding device 10. When the strip F which is wound-up on the reel core K is used up by the following packaging machine, the empty cartridge 1 is automatically separated from the production flow in response to the control signal of a sensor, and is withdrawn from the separating and binding device 10 via the vertically rising portion of the track arrangement 9. By means of a siding or branch line, which can be seen in the plan view of FIG. 10, the empty cartridges 1 reach a return track, so that a filled cartridge 1 can be fed to the separating and binding device 10.

In order to release the brake or friction disk 2*g* of the spindle 2 while withdrawing the strip F, and in order to avoid abrasion between the rotating spindle 2 and the cartridge 1, pairs of lift-out rollers 11 are provided not only for the semi-automatic embodiment of FIGS. 7 and 8, but also for the fully-automatic embodiment of FIGS. 9 and 10. In the operating position of the cartidge 1, the pairs of lift-out rollers 11 lift the spindle 2 of the cartridge 1 into a roll-off position within the cassette. The lift-out rollers, which are disposed against movably controlled push rods 11*a*, engage portions of the spindle 2 located externally of the cartridge 1 to lift the spindle 2, along with the reel B mounted thereon, against the force of the levers 1*d*. In this way, during withdrawal of the strip F, the spindle 2 is rotatably mounted on the pairs of lift-out rollers 11 with minimum friction. While the reel is being unwound or payed-out, the tension in the strip F is kept constant by means of a braking device which acts on the brake or friction disk 2*g*.

Figure 11:
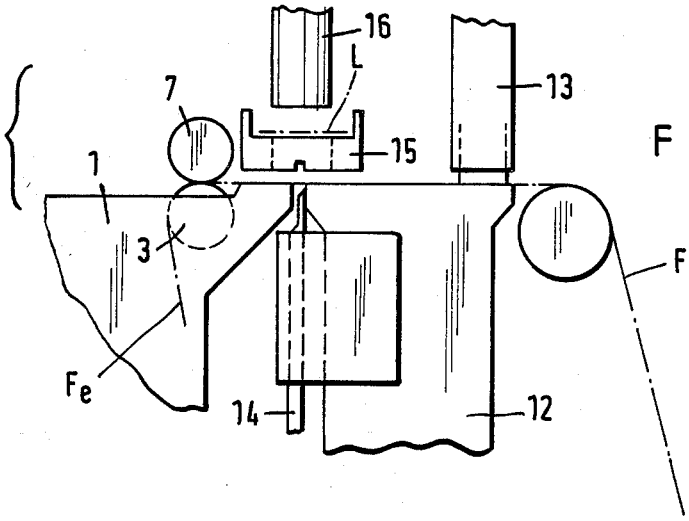
Figure 12:
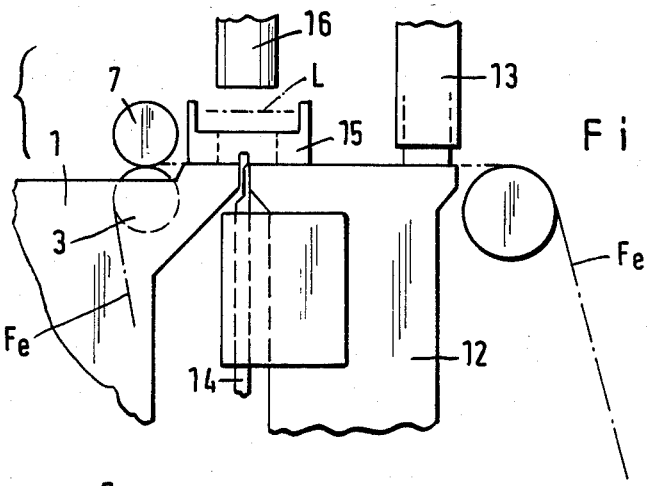

FIGS. 11 to 16 illustrate on specific embodiment of the separating and binding device 10 in various operating positions. This separating and binding device 10 is provided with a base or anvil, on the top side of which the end $F_e$ of the strip F which is being payed-out is clamped by means of a clamping mechanism 13, as shown in FIG. 11. Subsequently, the payed-out end $F_e$ is severed on that side which faces the cartridge 1 by means of a knife or doctor blade 14. As shown in FIG. 12, the knife 14 interacts with a cutting notch which is provided in a bridge 15.

Figure 13:
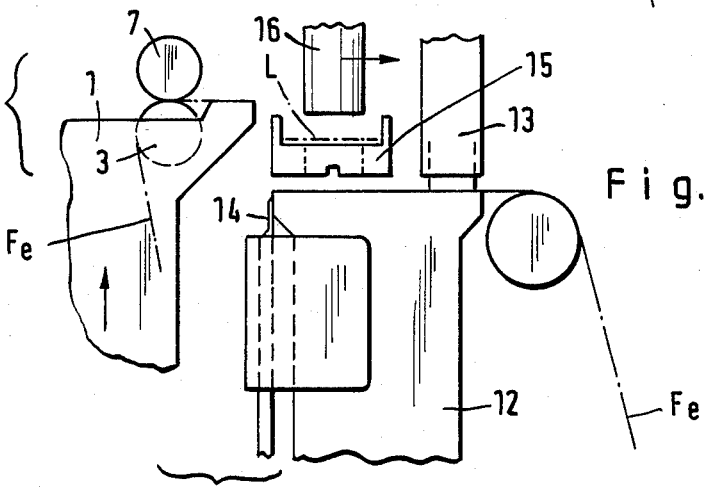

As illustrated in FIG. 13, after the remainder of the strip F has been severed from the strip end $F_e$, the bridge 15 is shifted toward the clamping mechanism 13, so that the empty cartridge 1 can be removed from above in the direction of the indicated arrow. The empty cartridge is replaced by a new cartridge 1 which has a full reel B, as shown in FIG. 14. The beginning of the strip $F_a$ of this cartridge 1 is clamped onto the projecting portion 1*f* of the cartridge 1 in the manner previously described. As indicated by the arrow in FIG. 14, the bridge 15 is now moved halfway over the clamped strip beginning $F_a$. After the bridge 15 has been lowered (FIG. 15), half of it rests on the beginning of the strip $F_a$, and the other half of it rests on the end of the strip $F_e$ which is clamped onto the anvil 12. A puch 16 which is disposed above the bridge 15 is now lowered. This punch 16 cuts an adhesive strip out of an adhesive tape L located in the bridge 15, and presses this adhesive strip through an aperture in the bridge 5 in such a way that half of it is disposed on the band end $F_e$ and of it is disposed on the beginning of the strip $F_a$, as shown in FIG. 15. In this way, the strip beginning $F_a$, which is flush against the band end $F_e$, is joined therewith. After the bridge 15 and the punch 16 have been lifted from the anvil 12, the band F which is wound onto the reel B of the new cartridge 1 can now be used. To prepare for a subsequent splicing or joining process, the punched-out portion of the adhesive tape L is wound onto a non-illustrated roller, so that for the next punching operation of the punch 16, a new section of the adhesive tape L, which is preferably wound onto a roller, is available.

FIGS. 17 to 20 illustrate an alternative embodiment for the separating and binding device 10. In this embodiment, in place of the bridge 15 a carriage 17 is provided which can be moved on a guide rod 18 of a frame 19 transverse to the direction of travel of the strip F. A punch 21, the height of which can be adjusted via a rod 20, is disposed on the carriage 17. The bottom of the punch 21 is provided with a plurality of transfer needles 21*a*. When the punch 21 is lowered, these transfer needles 21*a* are pressed into a portion of the adhesive tape L, which in the embodiment of FIGS. 17 and 18 is mounted in roll form on the frame 19.

Figure 19:
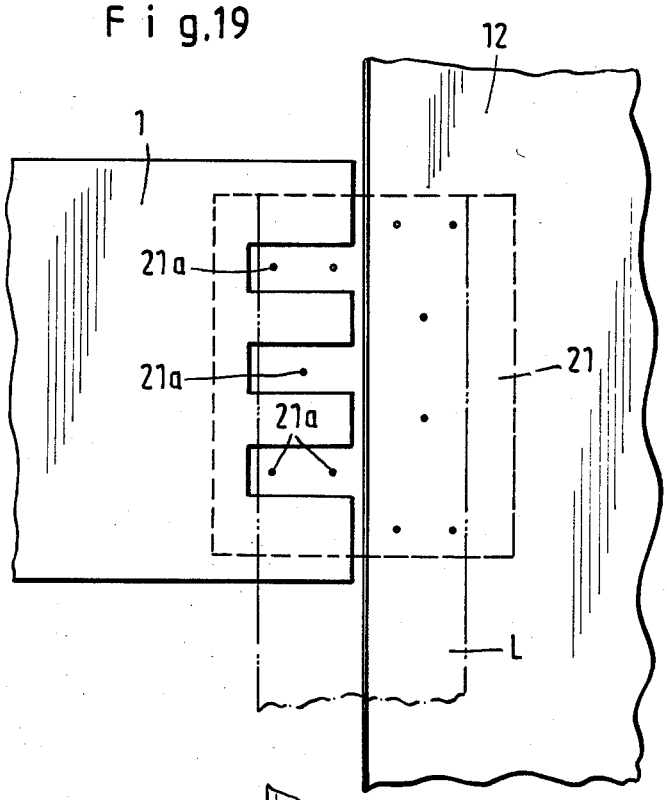
FIG. 19 is a plan view of a portion of the device of FIG. 17.
Figure 20:
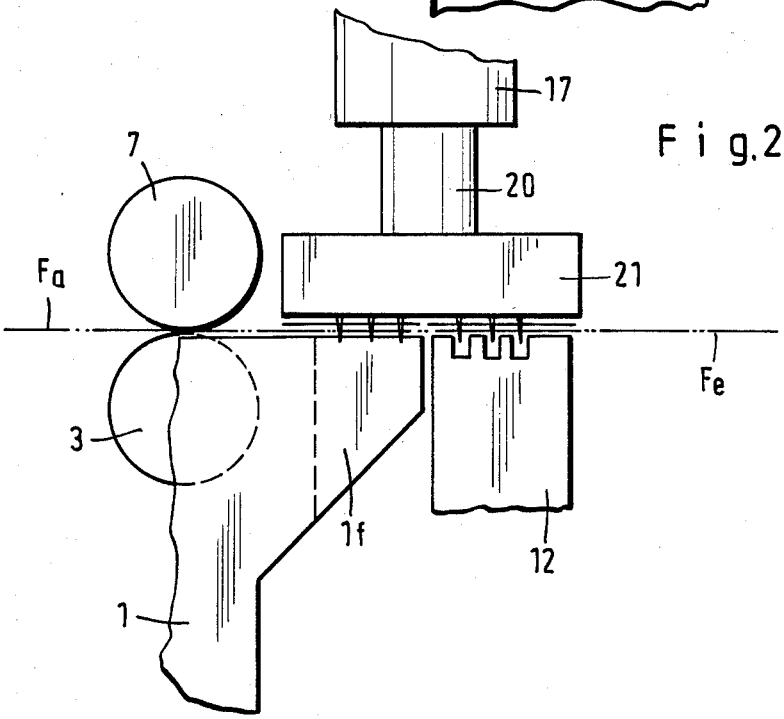
FIG. 20 is a side view of a portion of the device shown in FIGS. 17 and 18.

After the transfer needles 21*a* have been pressed into the adhesive tape L, the carriage 17 is moved out of its extreme right position, which is illustrated with solid lines in FIG. 17, into its extreme left position, which is illustrated with dot-dash lines in FIG. 17. In so doing, the punch 21 takes the adhesive tape L along with it, so that from the roll of the adhesive tape, a length of the adhesive tape L corresponding to the path of travel of the carriage 17 is payed-out or unwound. During subsequent lowering of the punch 21 by means of the rod 20, an edge of the punch 21 cuts that portion of the adhesive tape L which is held by the transfer needles 21*a* from the remainder of the adhesive tape L and presses the cut-off portion onto the strip end $F_e$ and the strip beginning $F_a$, which are held firmly in place on the anvil 12 and on the projecting portion 1*f* of the cartridge 1 in the manner previously described. This can best be seen in FIG. 20. Furthermore, FIGS. 19 and 20 show that the transfer needles 21*a* extend into appropriate apertures not only of the projecting portion 1*f* of the cartridge 1, but also of the anvil 12, so that the severed piece of the adhesive tape L can be reliably applied to the strip end $F_e$ and the strip beginning $F_a$.

Whereas in the previously described two embodiments, the separating and binding device 10 joined a strip end $F_e$ and a strip beginning $F_a$ which flushly abutted one another, FIGS. 21 to 24 show an embodiment with which the strip beginning $F_a$, which overlaps the strip end $F_e$, is welded or heat-sealed thereto.

Figure 21:
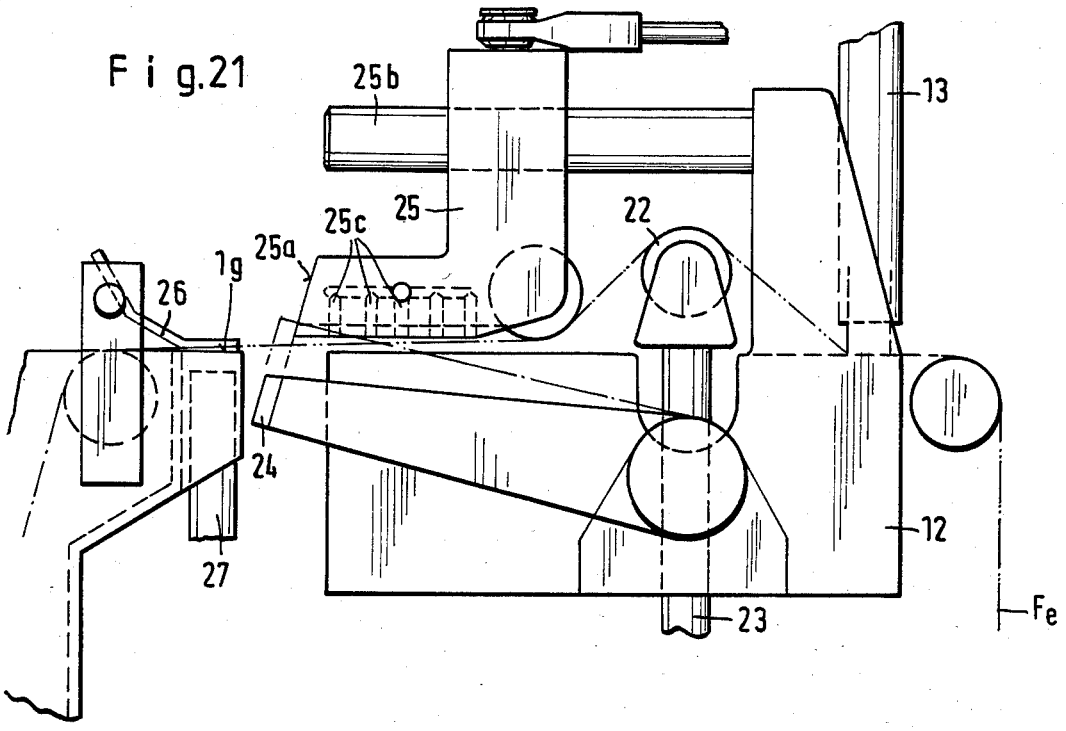
FIG. 21 is a side view of a third inventive embodiment of a separating and binding device.

FIGS. 21 and 22 again show an anvil 12 onto which is firmly secured by means of a clamping mechanism 13 the strip end $F_e$ of a pay-out reel B. In the anvil 12, a so-called loop-forming roller 22 is mounted on a push rod 23 in such a way that the height thereof can be adjusted. As shown in FIG. 21, the roller 22 lifts the strip end $F_e$, which originally rested flat on the top of the anvil 12, before the strip end $F_e$ is severed by means of a knife or doctor blade 24 which is pivotably mounted on the anvil 12 and cooperates with a knife edge 25*a* which is provided on a carriage 25. The carriage 25 is again mounted on a guide rod 25*b* in such a way that it can be moved in the longitudinal direction of the strip F.

Figure 22:
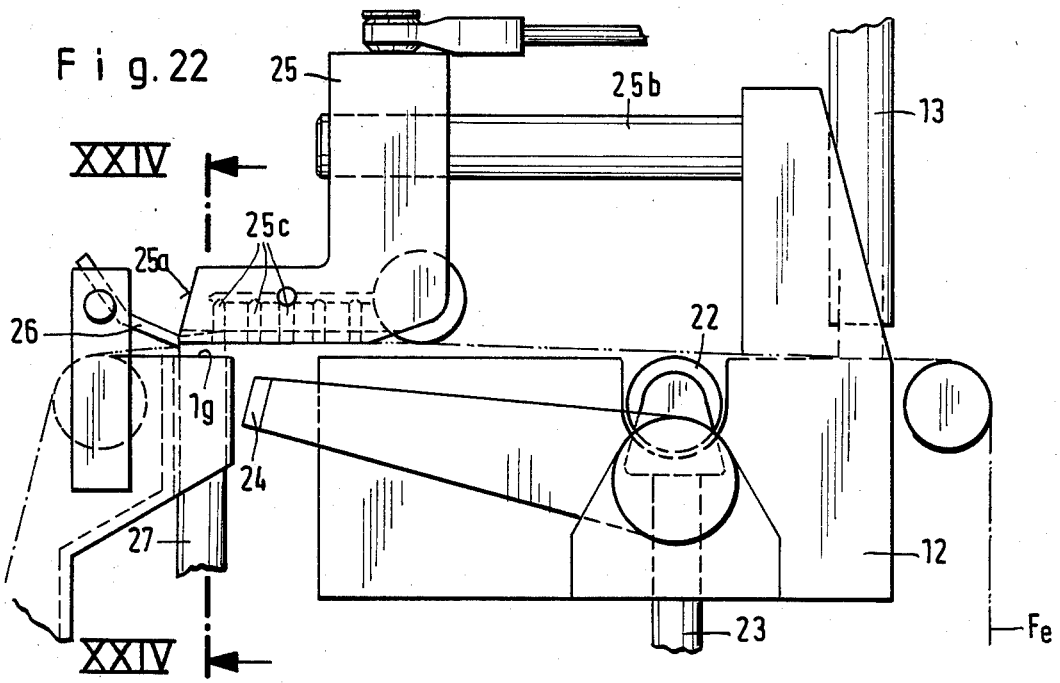
FIG. 22 shows the components of the device of FIG. 21 in a different working position.
Figure 24:
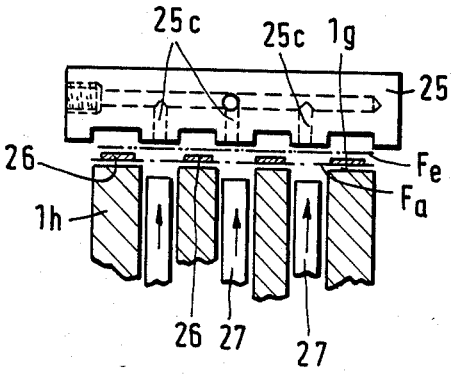
FIG. 24 is a vertical section taken along the line XXIV—XXIV of FIG. 22.
Figure 23:
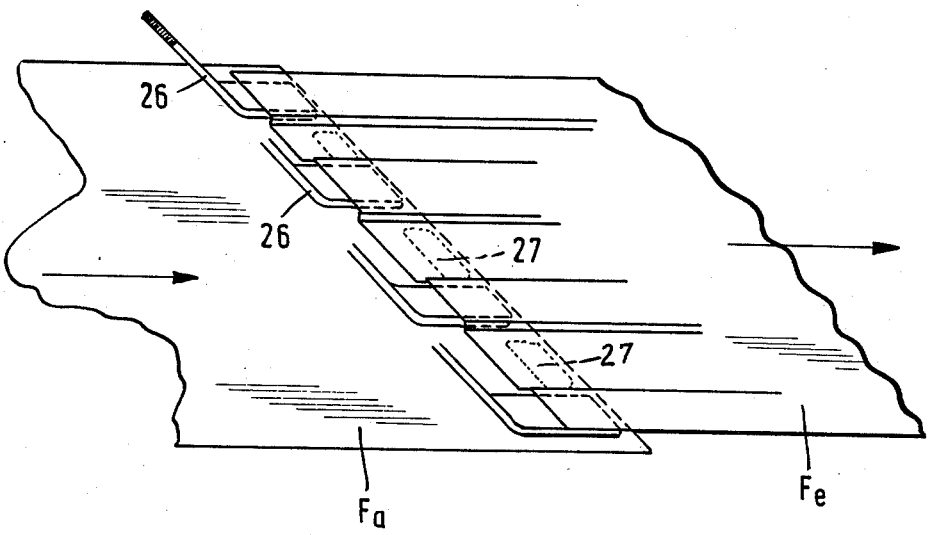
FIG. 23 is an isometric view of a portion of the device of FIG. 22.

After the strip end $F_e$ has been severed, which is indicated in FIG. 21 by dot-dash lines of the knife 24, the carriage 25 is shifted into the extreme position illustrated in FIG. 22. At the same time, the loop-forming roller 22 is retracted into the anvil 12. During the displacement procedure, the carriage 25 takes along the end of the strip F produced by the cutting process, for which purpose, in the presently described embodiment, it is provided with suction channels 25*c* which communicate with a vacuum-suction device. In this manner, the cut edge of the strip end $F_e$ passes over the strip beginning $F_a$ of a cartridge 1 which is provided with a full reel B, as illustrated in FIG. 23. The strip beginning $F_a$ is securely held in place on the support surface 1*g* of the cartridge 1 by means of finger-like retaining springs 26. This support surface 1*g* is formed by spaced-apart support projections 1*h*, which can be seen in section in FIG. 24.

The strip end $F_e$, which overlaps the strip beginning $F_a$ (FIG. 23), is now engaged by welding punches 27 which extend between the support projections 1*h* of the cartridge 1, and which press those parts of the strip beginning $F_a$ and of the strip end $F_e$ which are disposed between the finger-like retainer springs 26 against the underside of the carriage 25 and weld them together. The welded joint is indicated by a dotted line in FIG. 23. After the welding punches 27 have been withdrawn, and after the carriage 25 has been returned to its rest position as illustrated in FIG. 21, the strip F of the new cartridge 1 can be used. Naturally, the suction apparatus, which is operational via the suction channels 25*c*, is turned off while the strip F is being used.

The present invention is, of course, in no way restricted to the specific disclosure of the specification and drawings, but also encompasses any modifications within the scope of the appended claims.

What we claim is:

1. A device for joining the payed-out end of a strip, which had been wound into a reel, with the beginning of a strip of a new reel, each of said reels having a reel core; said device includes a storage device in which a certain length of said strip, which is conveyed over guide rollers, is stored, and out of which that amount of said strip which is necessary for continuous operation is dispensed during the joining process; said device comprises:

a respective cartridge for each reel; each cartridge has two wide sides, with each reel being disposed in its cartridge by being mounted on said wide sides thereof by means of a spindle which passes through its reel core and extends laterally out of said cartridge; means are disposed in said spindle for securing each reel against rotation during transport of its cartridge; each cartridge is provided with a support surface for receiving said strip beginning of a reel, with said strip beginning being adapted to be held firmly in place on said support surface; and a separating and binding device for receiving cartridges with full reels, and from which cartridges with empty reels can be withdrawn; said separating and binding device effects said joining of said strip end and said strip beginning.

2. A device according to claim 1, in which said cartridge is embodied as a parallelepipedal housing having a bottom, an open top, two wide sides, and two narrow sides; in line with said open top, said cartridge is provided with a projecting portion which extends beyond an adjacent one of said narrow sides; said support surface for said strip beginning is provided on said projecting portion.

3. A device according to claim 2, in which said bottom of said cartridge is provided with an arcuate recess as a support surface for a full reel.

4. A device according to claim 2, in which said spindle of said reel is nonrotatably secured to said wide sides of said cartridge during transport of the latter.

5. A device according to claim 4, in which expanding elements are provided in said spindle for connecting the latter with said reel core; and in which levers are provided on said wide sides of said cartridge for holding said spindle firmly in place.

6. A device according to claim 2, in which said spindle is provided with at least two spacer rings for axially securing at least one of said reels on said spindle, and said spindle in said cartridge.

7. A device according to claim 2, in which said spindle is provided with a brake disk for selectively preventing rotation and braking during withdrawal of said strip.

8. A device according to claim 2, which includes two pairs of lift-out rollers which in the operating position of said cartridge engage those portion of said spindle located externally of said cartridge; said lift-out rollers are adapted to lift said spindle into a pay-out position within said cartridge.

9. A device according to claim 2, which includes a hold-down device which presses against said support surface of said cartridge for firmly holding said strip beginning in place.

10. A device according to claim 9, in which said hold-down device is pivotably mounted to said cartridge to permit it to be swung away from said support surface to allow insertion of said strip beginning.

11. A device according to claim 2, which includes spaced-apart support projections which are provided next to one another on said projecting portion of said cartridge; and which includes finger-like retainer springs for firmly holding said strip beginning in place on said support projections.

12. A device according to claim 2, in which said separating and binding device is provided with guide rails which engage lower corners of said cartridges for effecting feed of full cartridges to, and withdrawal of empty cartridges from, said separating and binding device.

13. A device according to claim 12, which includes first guide rails for effecting feed of full cartridges, and second guide rails for effecting withdrawal of empty cartridges, said first and second guide rails being disposed at right angles to one another.

14. A device according to claim 2, which includes an automatically controlled track arrangement, and in which each cartridge is provided with a carriage for said track arrangement.

15. A device according to claim 2, in which said separating and binding device includes an anvil, a knife, and a clamping mechanism for clamping on said anvil that side of said payed-out end of a strip from an empty cartridge which is remote from said reel core thereof; the other side of said payed-out end, i.e. that side closest to said reel core, is severed from the latter by means of said knife; and which includes a bridge for effecting said joining of said strip end which is clamped on said anvil with said beginning of said strip of said new reel, which is disposed in a new cartridge which has replaced said empty cartridge.

16. A device according to claim 15, which includes a supply of adhesive tape which is disposed transverse to the longitudinal direction of said strip, said bridge being embodied as a guide means for said adhesive tape; and which includes a punch which can at least partially apply said adhesive tape to said strip end and to said strip beginning.

17. A device according to claim 16, in which said punch is adapted to punch out sections of said adhesive tape and apply them to said strip end and to said strip beginning, and in which said adhesive tape, with its punched-out portions, is adapted to be withdrawn continuously.

18. A device according to claim 15, in which said bridge is in the form of a carriage which can be moved transverse to the longitudinal direction of said strip; which includes a roll of adhesive tape; and in which said carriage is provided with a punch which is disposed thereon in such a way that the height thereof can be adjusted, and which is adapted to withdraw sections of adhesive tape from said roll thereof; said punch is provided with a knife edge for severing said sections of adhesive tape as it is lowered onto said strip end and strip beginning.

19. A device according to claim 15, which includes an extensible loop-forming roller disposed on said anvil; and in which said bridge is in the form of a carriage which is provided with a suction pick-up mechanism, which is movable in the longitudinal direction of said strip, for placing the overlap material formed by severing said strip end when said loop-forming roller is extended over said strip beginning when said loop-forming roller is retracted.

20. A device according to claim 19, in which said cartridge is provided with spaced-apart support projections on said projecting portion thereof; and in which said separating and binding device is provided with welding punches which are disposed between said support projections of said cartridge for joining together the overlapping strip beginning and strip end.

* * * * *